US005295780A

United States Patent [19]

Tanaka

[11] Patent Number: 5,295,780

[45] Date of Patent: Mar. 22, 1994

[54] DUMPING APPARATUS FOR BAG FILLED WITH MOLTEN SUBSTANCE

[76] Inventor: Sokichi Tanaka, 4-4-1106, Shiba-Daimon 1-chome, Minato-ku, Tokyo, Japan

[21] Appl. No.: 886,083

[22] Filed: May 21, 1992

[51] Int. Cl.[5] ..... B65G 65/34

[52] U.S. Cl. ..... 414/421; 414/404; 414/754; 198/373

[58] Field of Search ..... 414/403, 404, 406, 408, 414/418, 419, 420, 421, 425, 754; 198/373, 416, 586

[56] References Cited

U.S. PATENT DOCUMENTS

| | | | |
|---|---|---|---|
| 2,597,246 | 5/1952 | Kelly | 414/421 X |
| 2,741,815 | 4/1956 | Young, Jr. | 414/419 X |
| 3,119,139 | 1/1964 | Beard | 414/421 X |
| 4,724,656 | 2/1988 | Tanaka . | |
| 4,737,064 | 4/1988 | Tanaka | 414/421 |

*Primary Examiner*—Frank E. Werner
*Attorney, Agent, or Firm*—Sughrue, Mion, Zinn, Macpeak & Seas

[57] ABSTRACT

A dumping apparatus for a bag filled with molten substance wherein a tippler and a driving apparatus therefor are simplified and miniaturized in structure and a bag can be pulled out smoothly from within a carrying can with a minimized impact and without the possibility of break and can be transferred safely to a pallet. The tippler is mounted for pivotal motion around a stationary axis, and when it is pivoted from a first transfer position, fork prongs thereof are moved from between adjacent rollers of a roller conveyor to take up carrying cans from the roller conveyor. The carrying cans are thereafter held and moved by a side frame of the tippler, and when the tippler is pivoted to a second transfer position at which the side frame thereof is inclined downwardly, bags filled with molten substance slip somewhat from the carrying cans due to their own weight so that they are partially received on a pallet on a pallet conveyor. The pallet conveyor is then moved away from the tippler, whereupon the bags are fully pulled out from the carrying cans and transferred to the pallet.

5 Claims, 6 Drawing Sheets

DUMPING APPARATUS FOR BAG FILLED WITH MOLTEN SUBSTANCE

BACKGROUND OF THE INVENTION

1. Field of the Invention

This invention relates to a dumping apparatus for a bag filled with molten substance which pulls out, from within a carrying can which has been transported to the dumping apparatus together with a bag accommodated therein and filled with molten substance, the bag and transfers it to a pallet.

2. Description of the Prior Art

A dumping apparatus is already known and disclosed, for example, in U.S. Pat. No. 4,724,656 wherein a tippler to which a paper bag filled with asphalt latex or asphalt in a molten condition (such paper bag will be hereinafter referred to as bag filled with asphalt latex) is transported by means of a roller conveyor while accommodated in a carrying can is moved to take up the carrying can from the roller conveyor and then incline the carrying can downwardly while held thereon so that the bag filled with asphalt latex is pulled out from within the carrying can and transferred to a pallet.

The tippler of the dumping apparatus includes a pair of disks each having a window hole formed therein through which a carrying can pass and a plurality of rods which can hold a carrying can thereon. Each of the disks has serrations or teeth formed on an outer periphery thereof. The tippler is mounted for rotation on a travelling frame, which is moved horizontally together with the tippler. The serrations of the disks are held in direct engagement with a pair of racks, and the travelling frame is connected to a motor by way of a chain so that it may be moved back and forth by the motor. Or else, small gears are provided between the serrations of the disks and the racks such that they mesh with both of the latter. The racks are connected to piston rods of a pair of cylinders so that the travelling frame may be moved back and forth by contracting and expanding movements of the piston rods. When the travelling frame is moved back and forth, the tippler is moved back and forth away from and toward a pallet together with the travelling frame.

Meanwhile, a pallet conveyor for transporting a pallet from a transfer position of a bag filled with asphalt latex is mounted on a conveyor frame which is supported on a conveyor truck for upward and downward tilting motion around an end portion thereof remote from the tippler. The conveyor frame is pivoted from a normal horizontal position to an upwardly inclined position and then pivoted back to the normal horizontal position when a piston rod of a cylinder which is provided between the conveyor frame and the conveyor truck is expanded and then contracted. Further, the conveyor truck is separably connected to a slide rod to which rotation of a motor is transmitted after it is converted into linear motion so that the conveyor truck may be moved toward and away from the tippler by rotation of the motor.

With the conventional dumping apparatus, a carrying can held on the tippler is inclined downwardly while being moved horizontally toward a pallet by the tippler, and simultaneously the pallet is moved toward the tippler while it is being inclined such that an end portion thereof adjacent the tippler may be raised. Consequently, a bag filled with asphalt latex is discharged from the carrying can, whereupon an end portion thereof is received on the pallet which is inclined in the same direction as the bag filled with asphalt latex. After then, the carrying can is returned to its upwardly directed position while it is being retracted away from the pallet, and simultaneously the pallet is returned to its horizontal position. As a result of such returning movement, the bag filled with asphalt latex in the carrying can is let off from the carrying can and thus transferred to the pallet.

The dumping apparatus, however, has such problems as described below.

In particular, first, since the tippler is bodily moved forwardly or backwardly while being rotated, the driving mechanism therefor is complicated in structure and consequently is expensive, and besides since a large number of driving parts are involved, a high power is required.

Further, since the tippler is moved back and forth together with the travelling frame, the dumping apparatus is large in overall size.

Besides, since the tippler is moved horizontally toward a pallet while it is being rotated, a carrying can is tilted down while being advanced drawing an elliptic locus and the bag filled with asphalt latex in the carrying can is almost thrown to the pallet. Accordingly, the impact when an end portion of the bag filled with asphalt latex drops on the pallet is high.

In addition, since the carrying can rises, upon returning movement of the tippler, while being retracted drawing an elliptic locus, it will raise a portion of the bag filled with asphalt latex which has not been drawn out fully from and still remains in the carrying can. In this instance, since the asphalt in the paper bag still remains in a molten condition of a high temperature (for example, 200° C. or so), the bag filled with asphalt latex is flexible with a high weight. Therefore, when the portion of the bag filled with asphalt latex which remains in the carrying can is lifted by the rising carrying can, an edge of the mouth of the carrying can acts as if it bites into the bag filled with asphalt latex. Then, in this condition, the bag filled with asphalt latex is lifted while the mouth edge of the carrying can rubs the paper bag which is now in a weakened condition due to heat of the asphalt latex, and on the other hand, the bag filled with asphalt latex is drawn out fully from the carrying can while being lifted in this manner and then drops onto the pallet. Therefore, the probability that the paper bag may be broken is high. If the paper bag is broken, then the asphalt latex in a molten condition of a high temperature will leak from the paper bag and may soil not only the pallet but also the pallet conveyor, the conveyor frame, the conveyor truck and the driving apparatus for them, and much time and labor will be required for cleaning of them.

SUMMARY OF THE INVENTION

It is an object of the present invention to provide a dumping apparatus for a bag filled with molten substance wherein a tippler itself and a driving apparatus for the tippler are simplified and miniaturized in structure.

It is another object of the present invention to provide a dumping apparatus for a bag filled with molten substance wherein a bag filled with molten substance can be pulled out smoothly from within a carrying can with a minimized impact and without the possibly of break and can be transferred safely to a pallet.

In order to attain the objects, according to the present invention, there is provided a dumping apparatus for a bag filled with molten substance, which comprises a tippler having first and second transfer positions, a roller conveyor including a plurality of rollers for receiving a carrying can in which a bag filled with molten substance is accommodated and transporting the carrying can to the first transfer position at which the carrying can is to be transferred to the tippler, a pallet conveyor for receiving and positioning a pallet to the second transfer position at which the carrying can is to be transferred from the tippler to the pallet, the tippler having a plurality of first portions which extend horizontally between adjacent ones of the rollers of the roller conveyor when the tippler is at the first transfer position and a second portion which extends vertically when the tippler is at the first transfer position, tippler moving means for pivoting the tippler around a stationary axis parallel to the transporting direction of the roller conveyor alongside the roller conveyor from the first transfer position to the second transfer position at which the second portion of the tippler is inclined downwardly toward the pallet conveyor to allow the carrying can to slip down somewhat along the second portion, the tippler receiving, at the second portions thereof, the carrying can when the tippler is pivoted from the first transfer position to lift the second portions thereof from between the adjacent ones of the rollers of the roller conveyor, and pallet conveyor moving means for moving, after the tippler is pivoted from the first to the second transfer position together with the carrying can until the bag is partially received on the pallet, the pallet conveyor away from the tippler to pull out the bag from the carrying can thereby to transfer the bag to the pallet.

In the dumping apparatus, when the tippler is pivoted from the first transfer position to the second transfer position around the stationary axis, the first portions thereof first move away from between the adjacent rollers of the roller conveyor to take up a carrying can from the roller conveyor. The thus taken up carrying can is held by the first and second portions of the tippler and is tilted as the pivotal motion of the tippler proceeds until it is inclined downwardly as the second portion of the tippler is inclined downwardly. Consequently, a bag accommodated in the bag and filled with molten substance slips out a little from within the bag until it is partially received by a pallet on the pallet conveyor. After then, the pallet conveyor is moved away from the tippler, whereupon the bag partially received thereon is pulled out fully from the bag by the pallet conveyor so that the bag is transferred from the tippler to the pallet. After such transfer is completed, the tippler is pivoted back from the second transfer position to the first transfer position. Such pivotal motion assures removal of the bag from the carrying can. The thus emptied carrying can stands up by such pivotal motion of the tippler without lifting the bag transferred to the pallet, which eliminates an otherwise possible break of the bag which may be caused by lifting of the bag by the carrying can.

With the dumping apparatus, since the tippler includes a plurality of first portions and a second portion which extends perpendicularly to the first portions, it is simplified in structure, and consequently, the moving mechanism for moving the tippler is simplified in construction. Consequently, the dumping apparatus can be provided at a reduced cost.

Further, since the tippler is mounted only for pivotal motion around the stationary shaft but is not bodily moved horizontally, the moving mechanism therefor can be simplified and the overall size of the dumping apparatus can be reduced.

Furthermore, since a bag accommodated in a carrying can held on the tippler slips down naturally from the carrying can due to its own weight when the tippler is pivoted to the second transfer position, an impact upon an end portion of the bag when the bag, which is heavy with molten substance filled therein, is received on a pallet on the pallet conveyor is reduced. Consequently, an otherwise possible break of the bag is eliminated and inadvertent leakage of molten substance from the bag is prevented.

The tippler moving means may include a shaft supported for rotation around the axis and having the tippler secured thereto, and a hydraulic or pneumatic cylinder including a cylinder body connected to a stationary portion of the dumping apparatus and a piston rod connected to the shaft by way of a link to rotate the shaft around the axis by expanding or contracting motion of the cylinder body.

Preferably, the second portion of the tippler has a stopper provided thereon for engaging with a projection provided on an outer face of the carrying can to prevent the carrying can from slipping away from the second portion of the tippler when the tippler is pivoted to the second transfer position.

The dumping apparatus may further comprise a conveyor truck movable toward and away from the tippler and a conveyor frame supported on the conveyor truck and having the pallet conveyor mounted thereon, and the pallet conveyor moving means may include a hydraulic or pneumatic cylinder including a cylinder body mounted on the conveyor truck and a piston rod connected to a stationary portion of the dumping apparatus to move the conveyor truck toward and away from the tippler together with the pallet conveyor by expanding and contracting portion of the cylinder body. Preferably, the conveyor frame is supported at an end portion thereof adjacent the tippler for upward and downward pivotal motion, and the pallet conveyor moving means further includes another hydraulic or pneumatic cylinder connected between the conveyor frame and the conveyor truck to pivot the conveyor frame and the pallet conveyor on the conveyor frame from a normal horizontal position to a downwardly inclined position by expanding and contracting motion of a piston rod thereof after the bag is partially received onto the pallet on the pallet conveyor. Such pivotal motion of the pallet conveyor assures complete pulling out of the bag from the carrying can.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
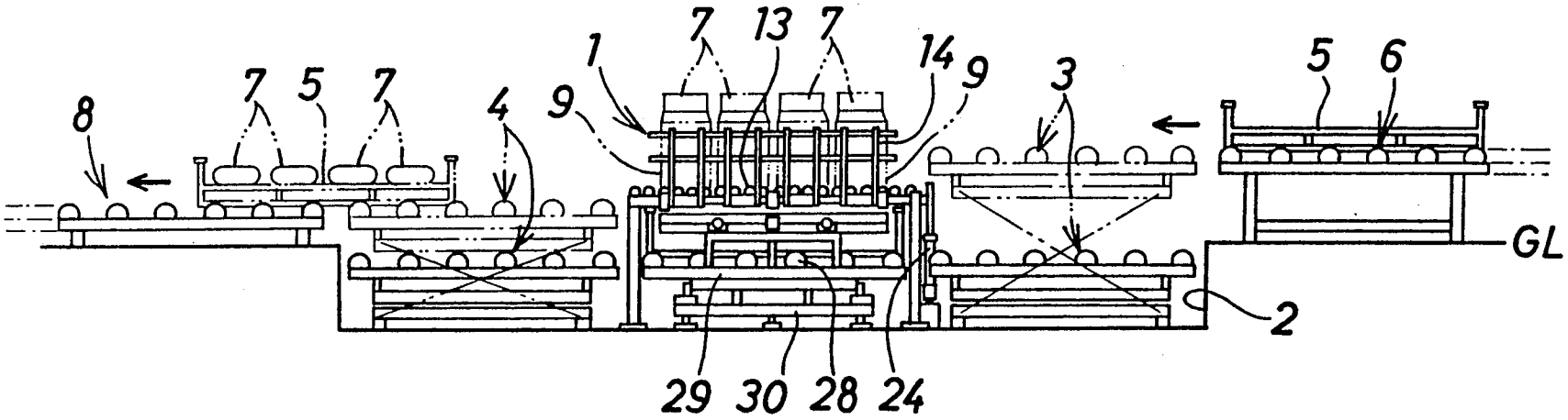
FIG. 1 is a front elevational view of a dumping apparatus to which the present invention is applied together with conveyors associated therewith.

Referring first to FIG. 1, there is shown a dumping apparatus for a bag filled with molten substance to which the present invention is applied. The dumping apparatus 1 is installed in a pit 2 so that a high operating efficiency may be assured in cooperating with other various apparatus not shown and conveyor lines because almost all of them are installed on the ground GL. A pallet carrying-in conveyor 3 and a pallet carrying-out conveyor 4 are installed on the right and left sides in FIG. 1 of the dumping apparatus 1 in the pit 2. The conveyors 3 and 4 are each moved upwardly and downwardly by means of a lifter not shown. Another conveyor 6 for transporting an empty pallet 5 is installed on the ground GL on the right side of the pit 2, and a further conveyor 8 for transporting a pallet 5, on which a bag 7 filled with asphalt latex is carried, is installed on the ground GL on the left side of the pit 2.

When an empty pallet 5 which has been transported on the conveyor 6 is transferred to the pallet carrying-in conveyor 3 which has been moved to its upper position by the lifter therefor, the conveyor 3 is subsequently moved down to a predetermined vertical position by the lifter, and at the vertical position, the empty pallet 5 is subsequently carried into the dumping apparatus 1 by the conveyor 3.

Meanwhile, referring to FIG. 2, bags 7 filled with asphalt latex, which are each accommodated in a carrying can 9 made of a metal, are carried one by one into the dumping apparatus 1 from the left side in FIG. 2 by a carrying can carrying-in conveyor 10 and then transferred by each four in a row onto the pallet 5 in such a manner as hereinafter described by the dumping apparatus 1. After then, the pallet 5 on which the bags filled with asphalt latex are carried is transferred to the pallet carrying-out conveyor 4 and then moved up to a predetermined vertical position together with the conveyor 4 by the lifter therefor. Then, the pallet 5 is transferred from the conveyor 4 to the conveyor 8, by which it is thereafter transported to an asphalt cooling and keeping location. Meanwhile, the carrying cans 9 thus emptied are then carried out rightwardly from the dumping apparatus 1 and then transported back to an asphalt filling apparatus (not shown) by a carrying can returning conveyor 11.

Figure 3:
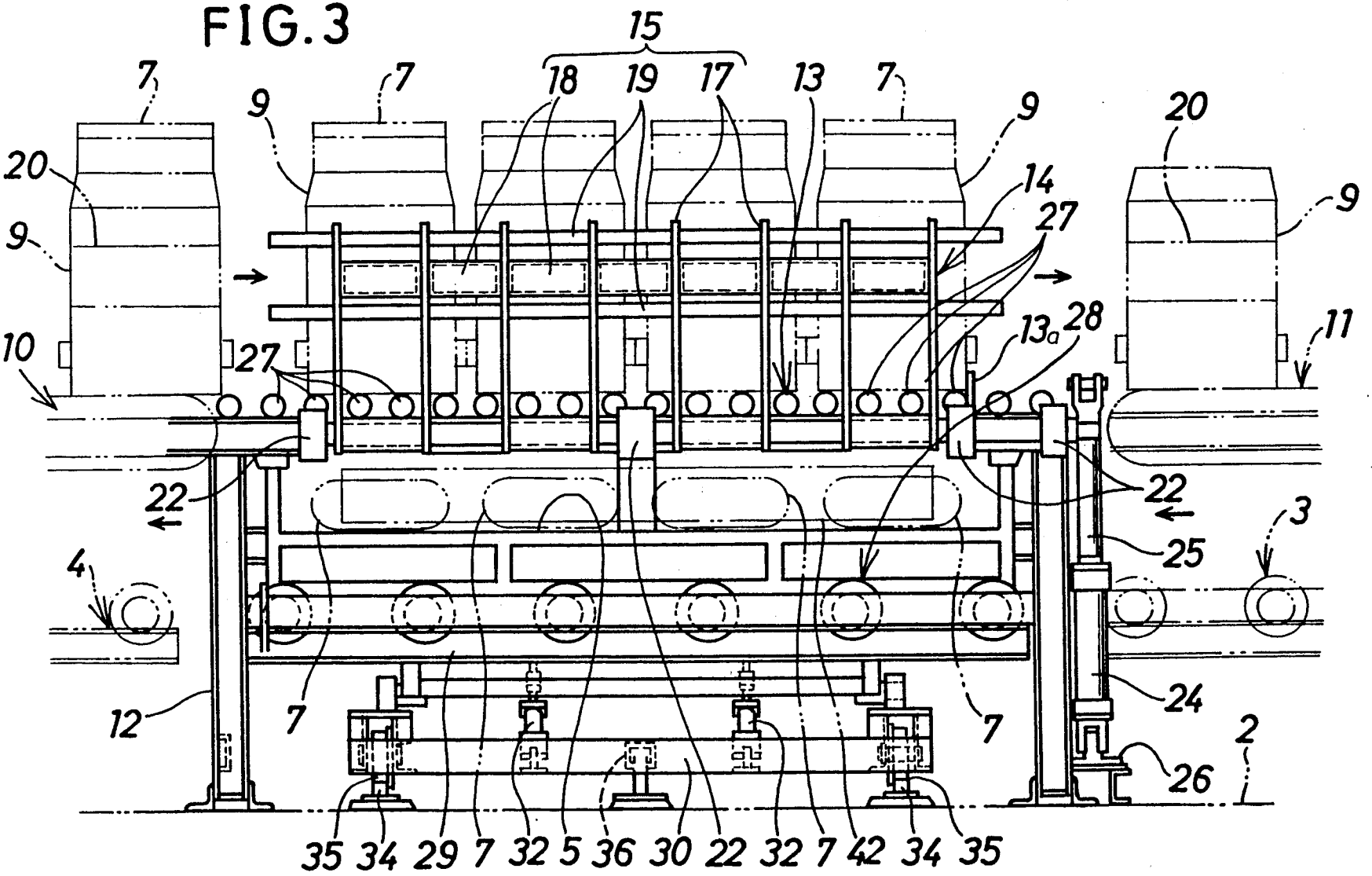
FIG. 3 is an enlarged front elevational view of the dumping apparatus.
Figure 4:
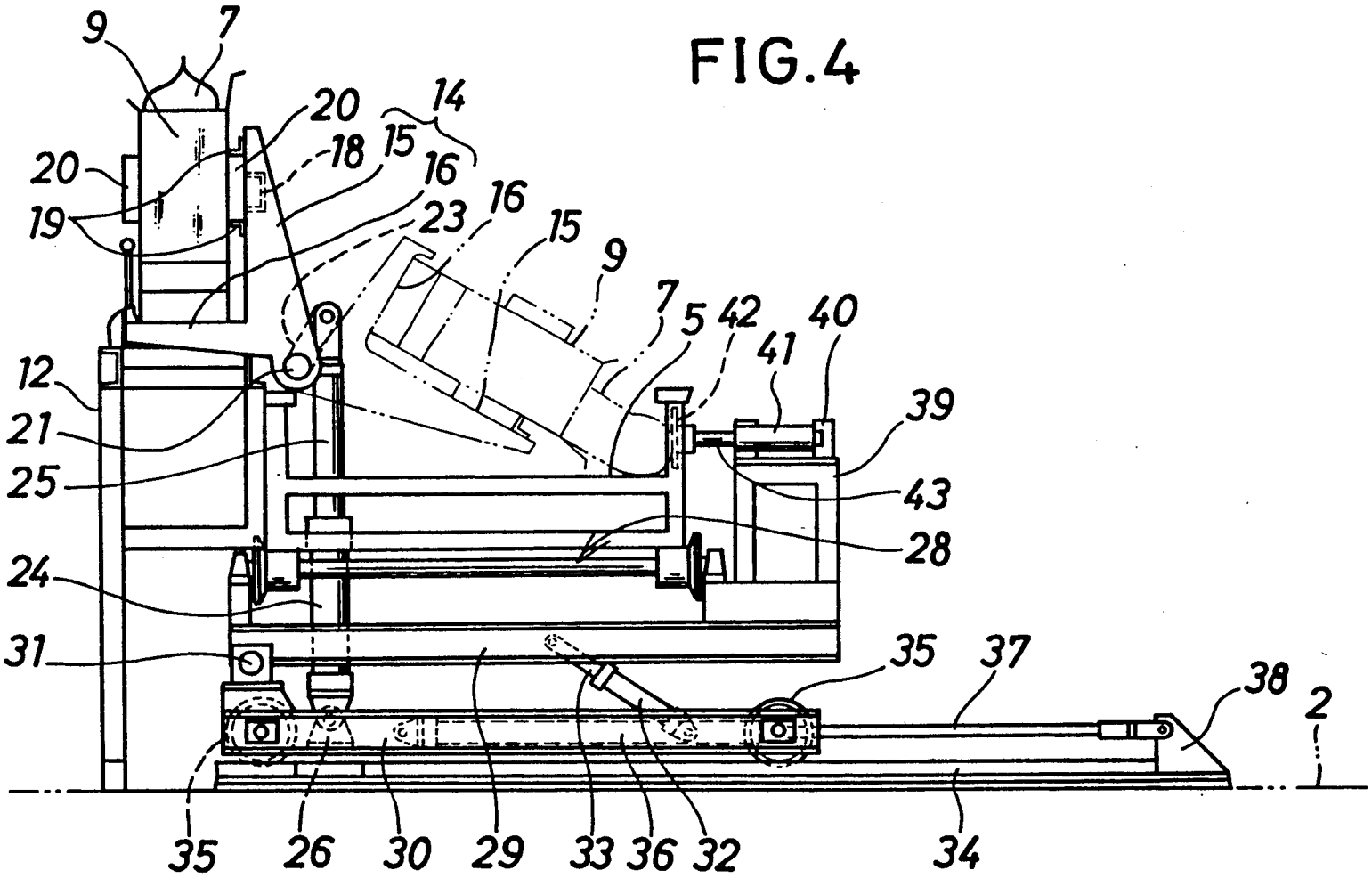
FIG. 4 is a side elevational view of the dumping apparatus in a normal condition.

Referring now to FIGS. 3 and 4, the structure of the dumping apparatus 1 is shown more in detail. The dumping apparatus 1 shown includes a roller conveyor 13 and a tippler 14 both mounted on an underframe 12 which is in turn secured to the bottom of the pit 2. The roller conveyor 13 is positioned at an equal vertical position as and between the carrying can carrying-in conveyor 10 and the carrying can returning conveyor 11 so that a carrying can 9 may be transferred straight between the roller conveyor 13 and the conveyors 10 and 11. A carrying can stopper 13*a* is mounted at an end portion of the roller conveyor 13 adjacent the carrying can returning conveyor 11 and is moved upwardly and downwardly by means of an actuator not shown. The roller conveyor 13 has a length sufficient to cover four carrying cans 9 on the roller conveyor 13 when the four carrying cans 9 are stopped by the stopper 13*a* so that they are arranged continuously in a row as seen in FIG. 3.

The tippler 14 generally has a fork-like profile and includes a side frame 15 and eight fork prongs 16 integrally formed on and extending perpendicularly from a lower end of the side frame 15. In particular, the tippler 14 is constructed such that eight L-shaped ribs 17 are connected in parallel at vertical portions thereof to each other with a spacer 18 interposed between each adjacent ones of the L-shaped ribs 17 and two upper and lower beam members 19 are secured in parallel to each other to the vertical portions of the L-shaped ribs 17 to construct the side frame 15 while the fork prongs 16 are formed from horizontal portions of the eight L-shaped ribs 17. The upper and lower beam members 19 serve as rails which engage with the opposite upper and lower faces of a projection 20 provided on an outer face of a carrying can 9 to guide the carrying can 9 on the roller conveyor 13 and also as stoppers for preventing a carrying can 9 from being let off from the side frame 15.

The tippler 14 is securely mounted on a shaft 21 which extends through corner portions of the eight L-shaped ribs 17. The shaft 21 is supported for rotation on the underframe 12 by means of four bearings 22 such that it extends horizontally in parallel to the direction of transportation of the roller conveyor 13, and consequently, the tippler 14 is mounted for upward and downward pivotal motion around an axis of the shaft 21 on the underframe 12.

Figure 5:
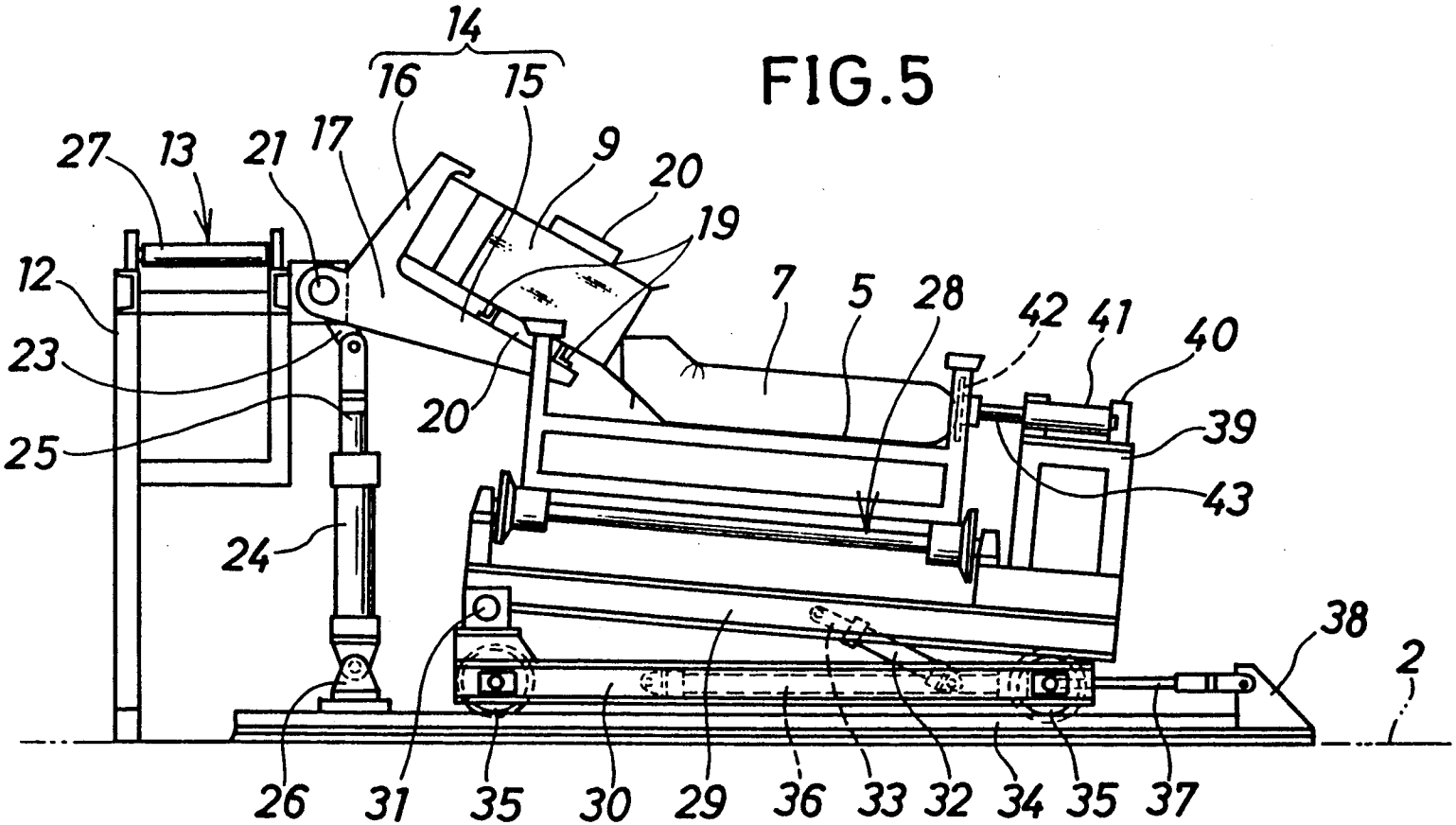
FIG. 5 is a similar view but showing the dumping apparatus in an operating condition.

An end of the shaft 21 is connected to a piston rod 25 of a tippler driving hydraulic cylinder 24 by way of a link 23. A cylinder body of the hydraulic cylinder 24 is mounted at a base end thereof for pivotal motion on a bearing 26 secured to the bottom of the pit 2. When the piston rod 25 is expanded as shown in FIG. 4, the tippler 14 is moved to its upright position as indicated by a solid line in FIG. 4, but when the piston rod 25 is contracted as shown in FIG. 5, the tippler 14 is moved to its tilted down position as shown in FIG. 5.

When the tippler 14 is in its upright position, the side frame 15 thereof stands uprightly alongside the roller conveyor 13 while the fork prongs 16 thereof extend horizontally below an upper face (transporting face) of the roller conveyor 13 between rollers 27 of the roller conveyor 13. On the other hand, when the tippler 14 is pivoted to its tilted down position, the side frame 15 is inclined downwardly while the fork prongs 16 are pulled out upwardly from between the rollers 27 of the roller conveyor 13 and retracted outwardly of the transporting face of the roller conveyor 13.

Figure 2:
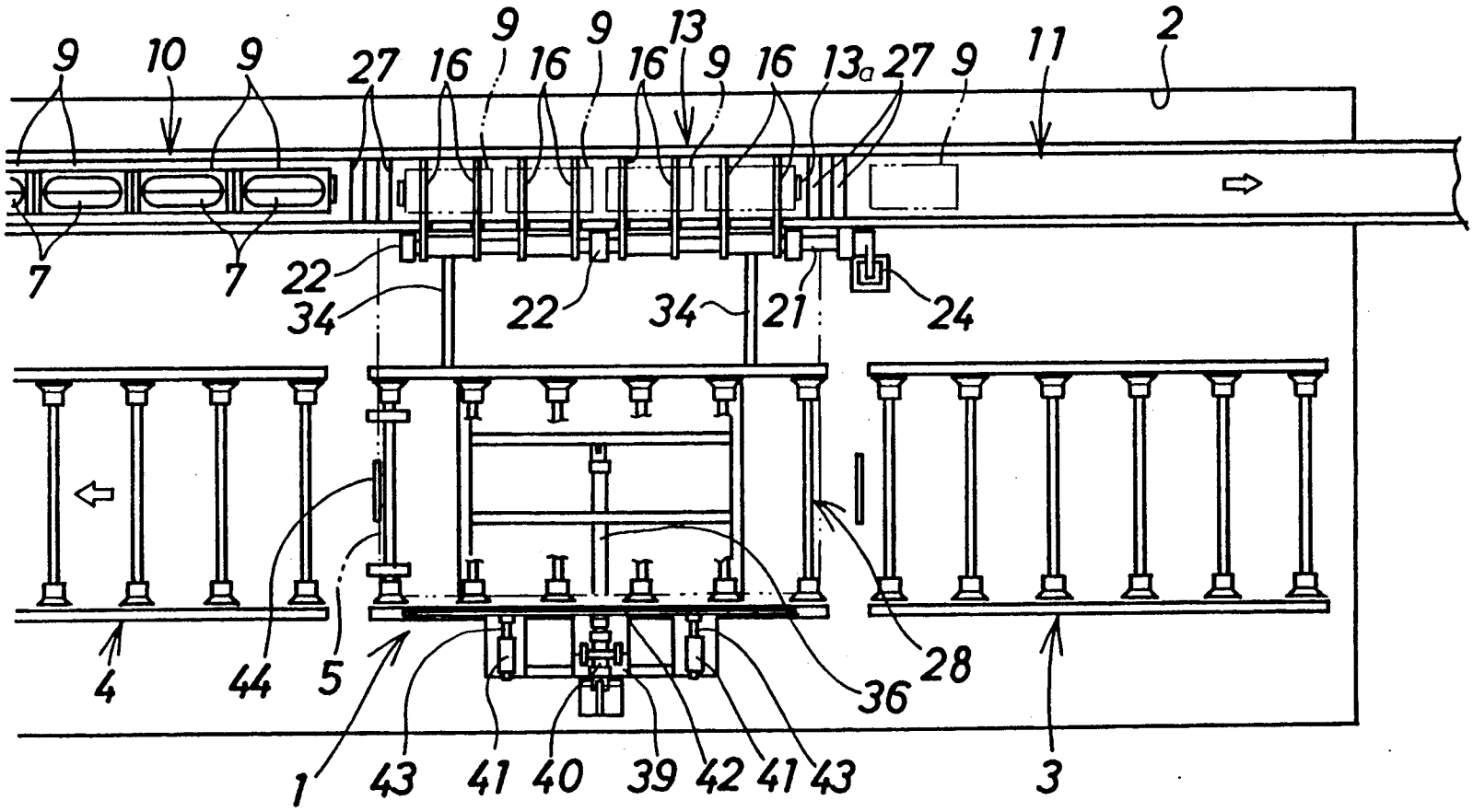
FIG. 2 is an enlarged plan view of the dumping apparatus and the conveyors shown in FIG. 1.

The dumping apparatus 1 further includes a pallet conveyor 28 located between the pallet carrying-in conveyor 3 and the pallet carrying-out conveyor 4 as shown in FIG. 2 such that a pallet 5 may be transferred between the pallet conveyor 28 and the conveyors 3 and 4. The conveyor 28 is mounted on a conveyor frame 29, which is in turn mounted on a conveyor truck 30. In particular, the conveyor frame 29 is mounted at a front end portion (end portion adjacent the tippler 14) thereof on a front end portion of the conveyor truck 30 by means of a shaft 31 so that it can be pivoted upwardly and downwardly integrally with the conveyor 28 around the shaft 31 on the conveyor truck 30.

A pair of left and right conveyor tilting hydraulic cylinders 32 are provided between the conveyor frame 29 and the conveyor truck 30 as shown in FIG. 3. An end portion of a piston rod 33 of each of the hydraulic cylinders 32 is connected for pivotal motion to the conveyor frame 29 while a base end portion of a cylinder body of each of the hydraulic cylinders 32 is connected for pivotal motion to the conveyor truck 30. When the piston rods 33 of the hydraulic cylinders 32 are both in an expanded position as shown in FIG. 4, the conveyor 28 and the conveyor frame 29 are held in individual horizontal positions. If the piston rods 33 are both contracted as shown in FIG. 5, then the conveyor 28 and the conveyor frame 29 both assume individual downwardly inclined positions.

The conveyor truck 30 has two pairs of wheels 35 which roll on a pair of left and right rails 34 provided on the bottom of the pit 2 such that it may travel forwardly and rearwardly along the rails 34. A hydraulic cylinder 36 for moving the conveyor truck 30 forwardly and rearwardly is mounted on the conveyor truck 30. An end portion of a piston rod 37 of the hydraulic cylinder 36 is connected to a bracket 38 secured to the bottom of the pit 2. When the piston rod 37 is in an expanded position as shown in FIG. 4, the conveyor truck 30 as well as the conveyor frame 29 and the conveyor 28 on the conveyor truck 30 assume their respective normal positions adjacent the tippler 14. When the piston rod 37 is contracted as shown in FIG. 5, the conveyor truck 30 as well as the conveyor frame 29 and the conveyor 28 are retracted away from the tippler 14.

A bed 39 is secured to a rear end portion of the conveyor frame 29, and a stopper moving pneumatic cylinder 40 is fixedly provided at the center of the bed 39 while a pair of guide pipes 41 are fixedly provided on the opposite sides of the stopper moving pneumatic cylinder 40 on the bed 39. An end of a piston rod of the stopper moving pneumatic cylinder 40 is connected to the center of a rear face of a bag stopper 42 in the form of a horizontally elongated plate. The bag stopper 42 includes a pair of rods 43 provided projectingly at left and right portions of a rear face thereof. The rods 43 are fitted for sliding movement in the left and right guide pipes 41 so that the bag stopper 42 is mounted horizontally for forward and rearward movement.

In operation, normally the tippler 14 assumes its upright position; the pallet conveyor 28 assumes its horizontal position; and the conveyor truck 30 is positioned adjacent the tippler 14 as shown in FIG. 4. Further, though not shown as such, the piston rod of the pneumatic cylinder 40 is in a contracted position and the bag stopper 42 is positioned outside a locus of movement of a pallet 5 on the pallet conveyor 28. Thus, an empty pallet 5 is carried onto the pallet conveyor 28 from the pallet carrying-in conveyor 3 in FIG. 2, and thereupon, the pallet 5 is abutted with and stopped by the pallet stopper 44 so that it is positioned at a predetermined position at which bags 7 filled with asphalt latex are to be transferred thereto. After then, the bag stopper 42 is advanced by the pneumatic cylinder 40 until it is positioned a little above an upper face of the pallet 5 as seen in FIG. 4.

Meanwhile, when carrying cans 9 in each of which a bag 7 filled with asphalt latex is accommodated are transferred from the carrying can carrying-in conveyor 10 to the roller conveyor 13, the projections 20 of each of them are engaged with the upper and lower beam members 19 of the tippler 14, and consequently, the carrying cans 9 are thereafter transported on the roller conveyor 13 while the projections 20 thereof are guided by the upper and lower beam members 19. Then, when a first one of the carrying cans 9 is stopped by the carrying can stopper 13a, the following carrying cans 9 are stopped by the first carrying can 9 and arranged in a row on the roller conveyor 13.

When four carrying cans 9 are received on the roller conveyor 13 (this is detected by a sensor not shown), the tippler driving hydraulic cylinder 24 is automatically rendered operative, and consequently, the piston rod 25 thereof is contracted so that the tippler 14 is tilted down as shown in FIG. 5. During such tilting down movement, the eight fork prongs 16 of the tippler 14 take up the four carrying cans 9, with each two fork prongs 16 corresponding to one carrying can 9, at a time from the roller conveyor 13. The thus taken up four carrying cans 9 are held on the fork prongs 16 without letting off from the side frame 15 of the tippler 14 since the projections 20 thereof remain in engagement with the upper and lower beam members 19, and accordingly, the carrying cans 9 are tilted down into a downwardly inclined position together with the side frame 15.

Figure 6:
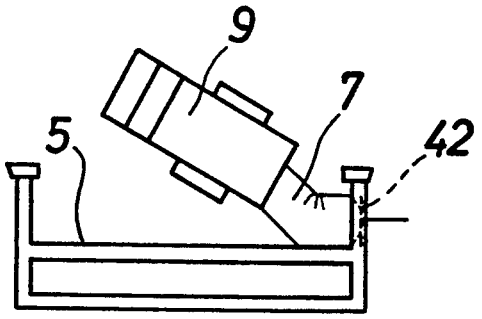
FIG. 6 is a schematic side elevational view showing a carrying can when it is tilted down so that an end portion of a bag therein filled with asphalt latex is received on a pallet in a horizontal position on the damping apparatus.

After the four carrying cans 9 are tilted down in this manner, the bags 7 filled with asphalt latex therein slip out a little from the carrying cans 9 until end portions thereof are received on the pallet 5 while at the same time they are abutted with the bag stopper 42 as seen in FIG. 6. Consequently, the four bags filled with asphalt latex assume such a position as shown in FIG. 6.

Figure 7:
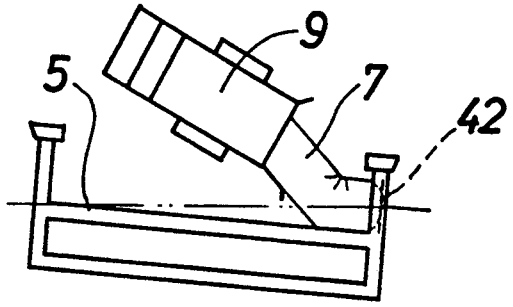
FIG. 7 is a similar view but showing the bag pulled out a little from the carrying can when the pallet is inclined downwardly from the position shown in FIG. 6.

After then, when the piston rod 33 of the conveyor tilting hydraulic cylinder 32 is contracted so that the conveyor frame 29 and the conveyor 28 are put into individual downwardly inclined positions, also the pallet 9 is put into a downwardly inclined position in the same direction as the carrying cans 9 as seen in FIG. 7. Consequently, the four bags 7 filled with asphalt latex are drawn out a little from the carrying cans 9.

Figure 8:
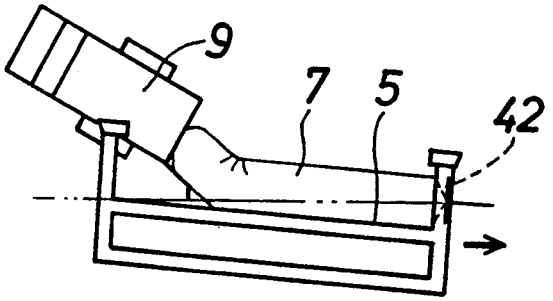
FIG. 8 is a similar view but showing the bag further pulled out from the carrying can when the pallet is retracted from the position shown in FIG. 7.
Figure 9:
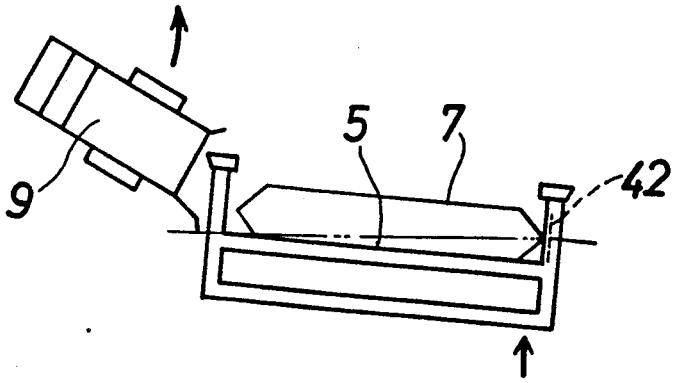
FIG. 9 is a similar view but showing the bag fully drawn out from the carrying can when the pallet is further retracted from the position shown in FIG. 8.

Subsequently, the piston rod 37 of the truck moving hydraulic cylinder 36 is contracted to retract the conveyor truck 30 while the carrying cans 9 and the pallet 5 remain in such conditions as described above. Thereupon, the pallet 5 is moved away from the carrying cans 9 while it remains in its inclined position as seen in FIG. 8 so that the four bags 7 filled with asphalt latex are pulled out at a time from the respective carrying cans 9 by the pallet 5 on which they are partially received and which are inclined in the same direction as the carrying cans 9, and consequently, they are transferred to the pallet 5 as shown in FIG. 9.

After then, the piston rod 25 of the tippler driving hydraulic cylinder 24 is expanded so that the tippler 14 is pivoted back to its upright position, whereupon, since the four bags 7 filled with asphalt latex have been pulled out fully from the carrying cans 9 and transferred to the pallet 5, the four carrying cans 9 thus emptied stand up at a time without lifting the bags 7 filled with asphalt latex on the pallet 5.

Subsequently, the piston rod 33 of the conveyor tilting hydraulic cylinder 32 is expanded so that the conveyor frame 29 and the conveyor 28 are returned to the horizontal positions. Thereupon, also the pallet 5 on which the four bags 7 filled with asphalt latex are carried is returned to its horizontal position. After then, the piston rod 37 of the truck moving hydraulic cylinder 36 is expanded to move the conveyor truck 30 forwardly to its original position, and the bag stopper 42 is retracted by the stopper moving pneumatic cylinder 40. Then, the pallet stopper 44 shown in FIG. 2 is retracted, and then the pallet 5 is transferred to the pallet carrying-out conveyor 4, by which it is carried out as described hereinabove.

On the other hand, when the tippler 14 is returned to its upright position, the emptied four carrying cans 9 are placed again onto the roller conveyor 13, by which they are subsequently transferred past the carrying can stopper 13*a* in its retracted position to the carrying can returning conveyor 11. After then, a similar sequence of operations to those described above will be repeated.

While the dumping apparatus for a bag filled with molten substance wherein four bags filled with asphalt latex are placed onto a pallet and transferred using the pallet is described above, the present invention is not limited to the specific arrangement, but can be applied to various dumping apparatus of different structures and various damping apparatus for different bags filled with various molten substances.

What is claimed is:

1. A dumping apparatus for a bag filled with molten substance, comprising:

a tippler having first and second transfer positions;

a roller conveyor including a plurality of rollers for receiving a carrying can in which the bag filled with molten substance is accommodated and transporting the carrying can to the first transfer position at which the carrying can is to be transferred to said tippler;

a pallet conveyor for receiving and positioning a pallet to the second transfer position at which the carrying can is to be transferred from said tippler to the pallet;

said tippler having a plurality of first portions which extend horizontally between adjacent ones of said rollers of said roller conveyor when said tippler is at the first transfer position and a second portion which extends vertically when said tippler is at the first transfer position;

tippler moving means for pivoting said tippler around a stationary axis parallel to a transporting direction of said roller conveyor alongside said roller conveyor from the first transfer position to the second transfer position at which said second portion of said tippler is inclined downwardly toward said pallet conveyor to allow the carrying can to slip down somewhat along said second portion, said tippler receiving, at said second portion thereof, the carrying can when said tippler is pivoted from the first transfer position to lift said second portion thereof from between the adjacent ones of said rollers of said roller conveyor; and pallet conveyor moving means for moving, after said tippler is pivoted from the first to the second transfer position together with the carrying can until the bag is partially received on the pallet, said pallet conveyor away from said tippler to pull out the bag from the carrying can thereby to transfer the bag to the pallet.

2. A dumping apparatus as claimed in claim 1, wherein said tippler moving means includes a shaft supported for rotation around said axis and having said tippler secured thereto, and a hydraulic or pneumatic cylinder including a cylinder body connected to a stationary portion of said dumping apparatus and a piston rod connected to said shaft by way of a link to rotate said shaft around said axis by expanding or contracting motion of said cylinder body.

3. A dumping apparatus as claimed in claim 1, wherein said second portion of said tippler has a stopper provided thereon for engaging with a projection provided on an outer face of the carrying can to prevent the carrying can from slipping away from said second portion of said tippler when said tippler is pivoted to the second transfer position.

4. A dumping apparatus as claimed in claim 1, further comprising a conveyor truck movable toward and away from said tippler and a conveyor frame supported on said conveyor truck and having said pallet conveyor mounted thereon, said pallet conveyor moving means including a hydraulic or pneumatic cylinder including a cylinder body mounted on said conveyor truck and a piston rod connected to a stationary portion of said dumping apparatus to move said conveyor truck toward and away from said tippler together with said pallet conveyor by expanding and contracting portion of said cylinder body.

5. A dumping apparatus as claimed in claim 4, wherein said conveyor frame is supported at an end portion thereof adjacent said tippler for upward and downward pivotal motion, and said pallet conveyor moving means further includes another hydraulic or pneumatic cylinder connected between said conveyor frame and said conveyor truck to pivot said conveyor frame and said pallet conveyor on said conveyor frame from a normal horizontal position to a downwardly inclined position by expanding and contracting motion of a piston rod thereof after the bag is partially received onto the pallet on said pallet conveyor.

* * * * *